United States Patent [19]

Shoptaugh

[11] Patent Number: 4,541,635

[45] Date of Patent: Sep. 17, 1985

[54] BOARD GAME STRUCTURE

[76] Inventor: Philip L. Shoptaugh, Piedmont, Calif.

[21] Appl. No.: 519,074

[22] Filed: Aug. 1, 1983

[51] Int. Cl.[4] ..... A63F 3/00

[52] U.S. Cl. ..... 273/284; 273/258

[58] Field of Search ..... 273/258, 287, 281, 284, 273/283, 148 R; 116/225, 306, 325, DIG. 28

[56] References Cited

U.S. PATENT DOCUMENTS

| | | | |
|---|---|---|---|
| 949,379 | 2/1910 | Patriache | 273/148 R |
| 3,584,597 | 6/1971 | Simmons | 116/225 |
| 3,731,934 | 5/1973 | Shoptaugh | 273/258 |
| 4,331,098 | 5/1982 | Rubano | 116/225 |

*Primary Examiner*—Richard C. Pinkham
*Assistant Examiner*—Scott L. Brown
*Attorney, Agent, or Firm*—Robert W. Dilts

[57] ABSTRACT

A board game structure of the type consisting of a plurality of playing pieces and a game board on which the playing pieces are moved having a given axis with a plurality of elongated rectilinear sliders mounted thereon for movement in side-to-side relationship to each other at a given common angle to the axis of the board. The board game has an improved detent structure for restraining each of the sliders in predetermined positions in their movement. Such improvement is based on the use of detent cam surfaces and detent cam followers held in engagement solely by the force of gravity acting on the sliders. An improvement in the structure for retaining the sliders on the game board against the force of gravity is disclosed.

18 Claims, 10 Drawing Figures

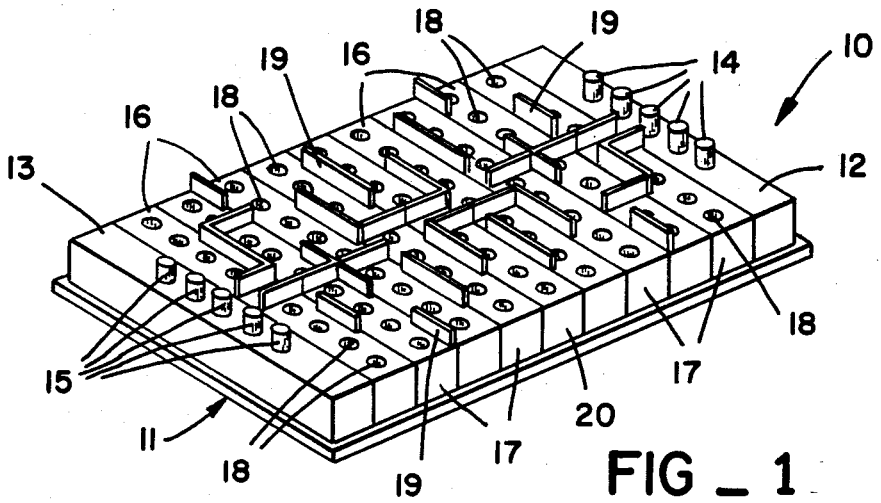
FIG _ 1
FIG _ 2
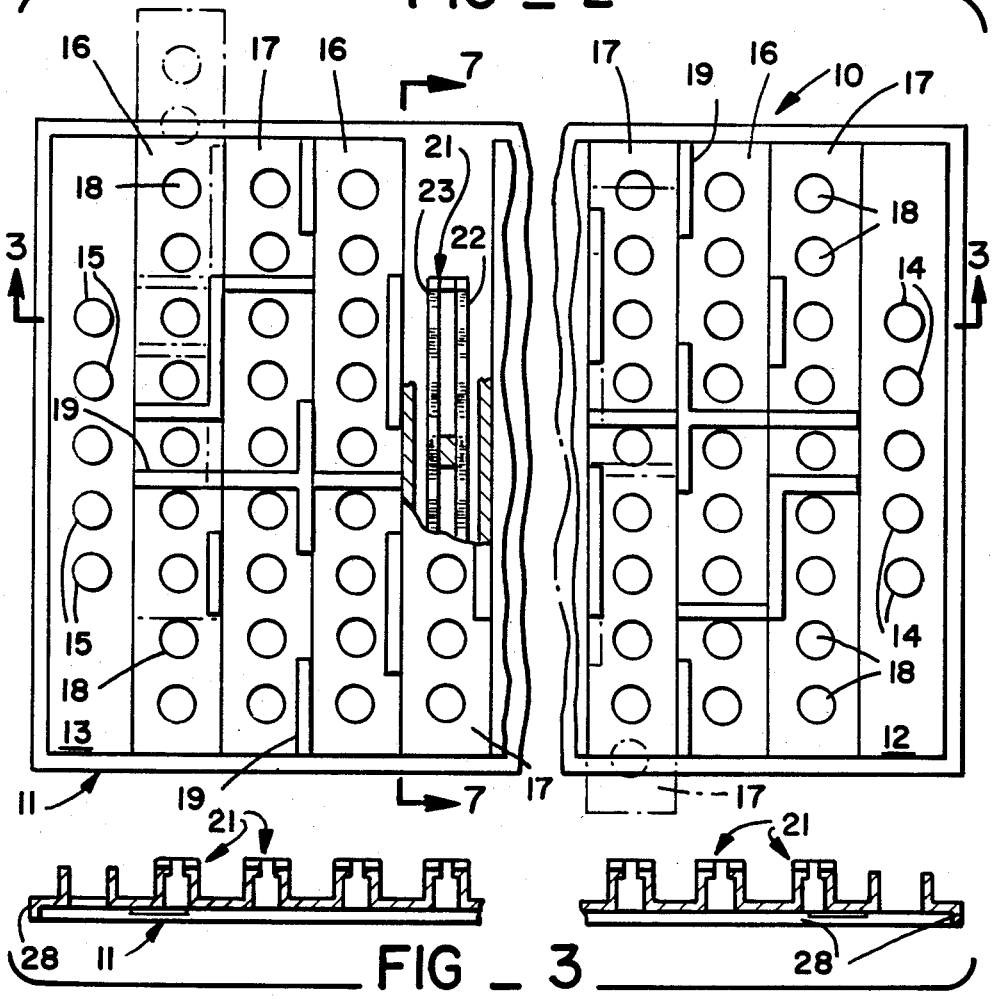
FIG _ 3

BOARD GAME STRUCTURE

DESCRIPTION

1. Field of the Invention

This invention relates to a board game including a game board having a given axis with a plurality of elongated rectilinear sliders mounted thereon for sliding movement from side-to-side with respect to each other at a common angle with respect to the axis of the game board and more particularly to an improved structure for mounting the sliders on the game board.

2. Background of the Invention

Board games are known in the prior art which consist of a plurality of playing pieces and a game board on which the playing pieces are moved having a given axis with a plurality of elongated rectilinear sliders mounted thereon for movement in side-to-side relation with respect to each other at a common angle to the axis of the board. Detent means have been provided which tend to restrain each of the sliders in predetermined positions of their movement with respect to each other and stop means have been provided for establishing the maximum extent of such movement of the sliders with respect to each other. U.S. Pat. No. 3,731,934, issued May 8, 1973, to Philip L. Shoptaugh, is representative of this type of board game and its method of use in play.

However, the movement of the sliders according to the teaching of the prior art has been unsatisfactory. The frictional resistance to movement of the sliders coupled with the detent mechanisms proposed in the prior art have produced an undesirable "feel" in play. In other words, the manual movement of the sliders is much more difficult than the manual movement of the playing pieces thus introducing an undesirable kinesthetic dichotomy in actual play, although the intent of the game is for movement of the game pieces and movement of the sliders to be interchangeable actions during the course of play.

In addition, the structural elements of this type of board game according to the teaching of the prior art, have been expensive to fabricate and require substantial manual labor to assemble. In general the structures of the prior art have comprised a plurality of mechanical elements which not only contributed frictional resistance to movement in use but also contribute to the cost of fabrication and assembly.

It is a primary object of this invention to provide an improved board game of the type discussed above which has an improved "feel" during use in play.

It is also an object of this invention to provide an improved board game of the type discussed above which is less expensive to fabricate and assemble.

SUMMARY OF THE INVENTION

The improvement of this invention is based upon the use of a detent means comprising a detent cam surface and a detent cam follower held in engagement solely by gravity forces acting on the sliders. The plurality of sliders may each be provided with a detent cam surface and the game board provided with the detent cam follower or vice versa. The sliders may be retained on the board by a pin and slot arrangement, the pin being provided with a head which may be forced through the slot and retained thereby. According to the preferred embodiment of the invention, the slot and cam surface are provided on the board by means of a pair of spaced rails projecting from the board and received within hollow slider members provided with an internal detent cam follower and retaining pin located centrally of the elongated axis of the sliders.

BRIEF DESCRIPTION OF THE DRAWING

This invention will be more fully understood by reference to the appended drawing wherein FIG. 1 is a perspective view of a board game according to the teaching of this invention.

FIG. 2 is an enlarged top plan view of FIG. 1, partially broken away to show internal structure thereof.

FIG. 3 is a cross-sectional view taken along line 3—3 of FIG. 2 with the sliders and fixed end pieces or home positions removed from the board game.

DETAILED DESCRIPTION OF PREFERRED EMBODIMENT

Figure 4:
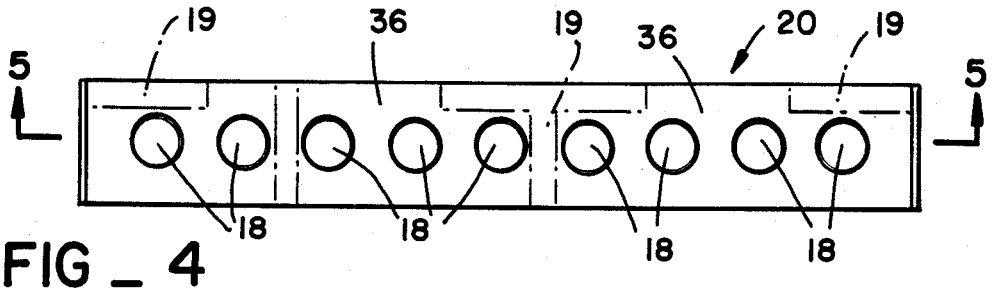
FIG. 4 is an enlarged top plan view of a slider according to the teaching of this invention with the location of barriers thereon indicated in phantom.

Referring to FIG. 1, a board game 10 according to the preferred embodiment of this invention is shown in perspective. According to this embodiment, the board game 10 comprises a rectangular game board 11 having a given axis of elongation with end members 12 and 13 fixedly mounted thereon to constitute home positions and having different colors corresponding with the color of different sliders, as will be more fully described hereinafter.

The board game 10 is designed for use by two players from opposite ends thereof. Thus a plurality of playing pieces 14 which may be of any convenient form but according to this embodiment comprise generally cylindrical pegs loosely received in cylindrical holes in end piece 12 are provided for the first player and playing pieces 15 comprising generally cylindrical pegs loosely received in cylindrical holes in the other end piece 13 are provided for the second player. The playing pieces 14 and 15 have a color corresponding to the color of the end pieces 12 and 13, respectively.

Between the end pieces 12 and 13 are a plurality of sliders mounted on the game board 11 for sliding movement in side-to-side relation transversely of the axis of elongation thereof. Certain of the sliders 16 have a color corresponding to the color of the end piece 12 and others of the sliders 17 have a color corresponding to the color of the other end piece 13. Thus, each player controls the sliders 16 or 17 having color corresponding to the color of their home position and playing pieces 12/14 and 13/15, respectively.

Each of the sliders between the end pieces 12 and 13 is provided with a plurality of playing positions 18 for the playing pieces 14 and 15. According to this embodiment 10 the playing positions comprise cylindrical holes dimensioned to receive the cylindrical peg playing pieces 14 and 15. In addition, each of the sliders between the end pieces 12 and 13 are provided with barriers 19 which project from the top surface of the sliders and may have different configurations on different sliders. Except for their color and the configuration of the barriers 19 thereon, the sliders are identical in their structure according to this embodiment of the invention. Also, according to this embodiment of the invention, the central one 20 of the sliders has a color differing from the other sliders 16, 17 and end pieces 12, 13. In play, the slider 20 may be moved by either player and since it is identical to the other sliders except for its color and the configuration of the barriers 19 thereon, it will be described in detail hereinafter as representative of all of the sliders 16, 17, 20.

Play on the board game 10 may take place in accordance with the teaching of the prior art according to various rules. Basically, each player in turn may either move one of his playing pieces 14, 15 or one of the sliders 16, 17 corresponding in color to his playing pieces with the object of each player being to be the first to move all of his playing pieces from his home position to the home position of the other player. It will be understood that the function of the barriers 19 is to impede the movement of the playing pieces and thus the players will move their sliders to position the barriers thereon in such a way as to impede movement of their opponent's playing pieces and facilitate the movement of their own playing pieces.

From the above it will be understood that during any given turn in play, a player will either manually remove one of his playing pieces 14, 15 from a hole in an end piece 12, 13 or slider 16,17,20 and move it to another hole therein or a hole in an adjacent end piece 12,13 or slider 16,17,20, or alternatively, move one of the sliders transversely of the axis of the board 11. To this end, a detent means is provided to restrain the sliders in each of a plurality of different positions in their transverse movement so that the player may only move the slider from one position to an adjacent position. Stop means are, of course, provided to establish the maximum amount of transverse movement of each slider in either direction with respect to the axis of elongation of the game board 11.

Since the movement of a game piece and the movement of a slider are alternative movements to each other in the play of the board game 10, it is necessary that such movements be compatible with each other in terms of their ease of accomplishment and finality in execution. If it is easy to move the game piece but difficult to move the slider, or vice versa, the alternative nature of such actions will be impaired in play. Similarly, if there is a greater sense of finality in the execution of one of such movements in comparison to the other, the alternative nature of the movements will be impaired. In other words, the game board 10 must have a certain "feel" in play in order to be satisfying in use. The mechanically complicated structures of the prior art have not addressed this problem even though such structures have been expensive and complicated to fabricate. In particular, the mounting of the sliders on the board in board games of this type proposed by the prior art has introduced substantial sliding friction into the movement of the sliders whereas no such sliding friction is involved in the movement of the playing pieces. In addition, the detent means used to restrain the sliders at various positions in their movement have either introduced additional frictional forces which are not involved in the movement of a playing piece from one position to another or have detracted from the finality in execution of a movement of the slider as compared to the finality in execution of a movement of the playing piece.

According to this invention, a detent action relying solely on gravity forces acting on the sliders with minimum frictional resistance to the movement of the sliders is used in order to provide a highly desirable congruity in the "feel" of the movement of a slider as compared to the movement of a game piece in play. In addition, a simple, inexpensive and easy to assemble structure is provided for holding the sliders on the game board against gravitational or other forces inadvertently applied thereto and tending to separate the sliders from the board. Such restraining means comprises a pin and slot structure with a head being provided on the pin which may be forced through the slot to thereafter restrain the removal of the pin from the slot without introducing frictional forces in play. It will be understood that the gravitational detent means and pin and slot arrangement will enable sliding movement of the sliders with a minimum of friction as will be more fully described hereinafter.

Referring to FIG. 2, an enlarged top plan view of the board game 10 of FIG. 1 is shown. A portion of one of the sliders 17 is broken away to show the portion of the slider mounting structure 21 which is carried by the board 11.

Figure 7:
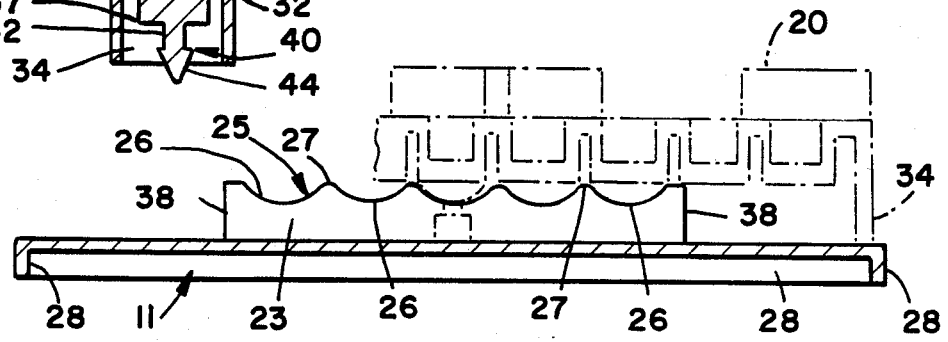
FIG. 7 is a cross-sectional view taken along line 7—7 of FIG. 2 with a portion of a slider shown in phantom.
Figure 8:
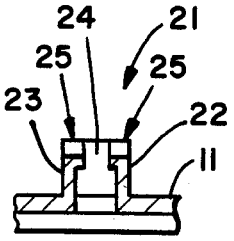
FIG. 8 is an enlarged fragmentary cross-sectional view of the game board showing a pair of rails provided thereon.

As best shown in FIG. 3, the game board 11 is provided with a plurality of such mounting structures 21 spaced from each other and each adapted to receive a different one of the sliders 16, 17 and 20. As best shown in FIG. 8, each mounting structure 21 includes a pair of upstanding elongated walls or rails 22, 23 spaced from each other to define a slot 24 and each having an inwardly extending flange at the free end thereof. As best shown in FIG. 7, the exterior surface of the flanges at the free ends of the rails 22, 23 are each provided with a detent cam surface 25 comprising concave arcuate depressions 26 separated by relatively flat shoulders 27. The game board 11 including the slider mounting structure 21 may conveniently be molded of plastic as an integral unit, it being understood that the slot 24 between the rails 22, 23 of the slider mounting structure extends all the way through the game board 11. The game board 11 may be provided with a downwardly extending flange 28 about the periphery thereof for structural rigidity.

Figure 5:
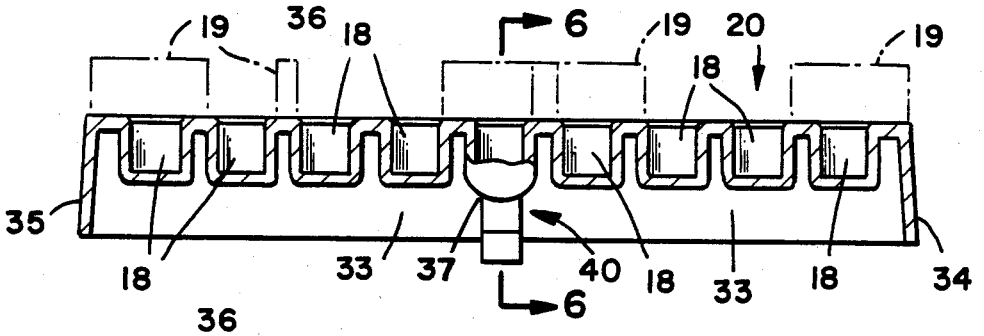
FIG. 5 is a cross-sectional view taken along line 5—5 of FIG. 4 with the pin structure of such slider shown in full.
Figure 6:
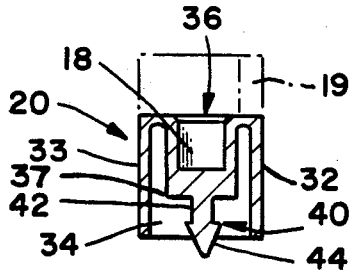
FIG. 6 is a cross-sectional view taken along line 6—6 of FIG. 5.

Referring to FIGS. 4, 5 and 6, the sliders (of which slider 20 is representative) each comprise an open bottom, generally rectangular, elongated hollow box having a pair of side walls 32, 33, a pair of end walls 34, 35 and a top wall 36. The top wall 36 is provided with a plurality of inwardly projecting, generally cylindrical spaced depressions or blind holes 18. The top wall 36 may also be provided with upwardly projecting barrier walls 19 between certain adjacent holes 18 and/or between certain of the holes 18 and the edge of the slider 20, as indicated in phantom. As pointed out above, the barrier walls 19 may have different configurations on different sliders 16, 17, 20 but all of the sliders are otherwise identical to the slider 20.

As best shown in FIG. 5, the depression or blind hole 18 located centrally of the elongated axis of the slider 20 is longer than the other depressions or blind holes 18. The closed or blind end of such central depression or blind hole 18 is provided with a convex arcuate detent cam follower surface 37 substantially matching the concave arcuate detent camming surface 26 of the rails 22, 23.

As best shown in FIG. 7, the slider mounting structure comprising rails 22 and 23 have an axis of elongation shorter that the axis of elongation of the sliders 20 and are symmetrically located transversely of the axis of elongation of the board 11. The side walls 32, 33 of the sliders 20 are spaced from each other to receive the slider mounting structure 11 with a loose fit. The axis of elongation of the sliders 20 is substantially equal to the width of the game board 11 and the spacing between the blind holes 18 in the slider is substantially equal to the spacing between the lower most point of the concave detent camming surfaces 26 of the rails 22, 23. The rails 22, 23 extend at the desired angle of movement with respect to the axis of the game board 11 and the height of the rails 22, 23 with respect to the length of the side 32, 33 and end 34, 35 walls of the slider 20, as well as the length of the central blind hole 18 of the slider 20 and the detent cam follower surface 37 thereon are such that the slider 20 will rest on the upper surface of the game board 11 when the detent cam follower surface 37 rests on one of the concave detent camming surfaces 26 due to the force of gravity acting on the slider with respect to a supported game board 11.

Figure 9:
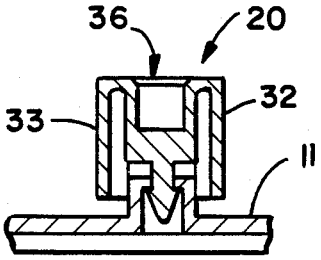
FIG. 9 is a cross-sectional view similar to FIG. 8 but including a cross-sectional view of a slider mounted on the rails in the process of being moved from one detent position to the next.

As best shown in FIG. 9, when the slider is moved transversely of the axis of the game board 11, the cam follower 37 will ride upwardly on the shoulders 27 of the detent cam surface of the rails 22, 23, causing the slider 20 to assume a raised position with respect to the game board 11 until sufficient movement has occurred to cause the detent cam surface 37 to mate with the next adjacent convex cam surface 26. The end walls 34, 35 of the slider 20 will cooperate with the ends 38 (see FIG. 7) of the rails 22, 23 to provide a stop means for limiting the movement of the sliders 20 in either direction transversely of the axis of the game board.

From the above, it will be seen that the only contact between the sliders 20 and the game board 11 will be the substantially line contact which occurs between the detent follower surface 37 and the detent camming surface of the rails 22, 23. In other words, the sliders 20 will be substantially balanced on the detent follower surface 37. Such balancing is enhanced by the fact that the force necessary to move the sliders 20 will be applied at one end thereof by a finger of the player, which will tend to inherently balance the slider during movement.

It is, of course, desirable to provide some means for preventing the sliders 16, 17, 20 from being inadvertently removed from the game board 11 due to gravitational or other forces acting thereon. According to the preferred embodiment of this invention as best shown in FIGS. 5 and 6, the sliders 20 are provided with a central pin 40 projecting from the arcuate detent cam follower surface 37. The pin 40 has a shank 42 dimensioned to be loosely received between the rails 22, 23 of the slider mounting structure. The free end of the pin 42 is provided with a head 44 tapering from dimensions smaller than the shank to dimensions slightly larger than the shank and adapted to engage the flanges at the free ends of the rails 22, 23. Thus, the head 44 of the pin 40 may be forced into the slot 24 defined by the rails 22, 23. The shank 42 of the pin 40 is made long enough to allow the detent action shown in FIGS. 9 and 10 to occur during transverse movement of the sliders 20 without engagement of the head 44 of the pin 40 with the flanges at the free ends of the rails 22, 23. Thus, the pin 40 only prevents the sliders 20 from being removed from the board 11 due to engagement of the head 44 thereof with the flanges at the free ends of the rails 22, 23 and does not introduce any frictional resistance to the desired transverse movement of the sliders.

Figure 10:
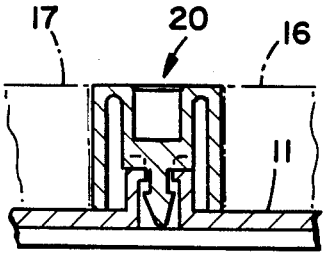
FIG. 10 is a cross-sectional view similar to FIG. 9 but showing the slider at rest in a detent position.

It will be understood that the end piece 12, 13 and sliders 16, 17, 20 may be molded of plastic, for example, as integral units separate from the board and then quickly and easily assembled with each other thereon. In molding the end pieces 12, 13 and sliders 16, 17, 20, it is desirable to provide a slight taper on the side 32, 33 and end 34, 35 walls thereof to facilitate their removal from the mold. Thus, as best shown in FIG. 10, the adjacent slide walls of the end pieces 12, 13 and sliders 16, 17, 20 will have a few degrees or so of taper from larger dimensions at the open bottom thereof to smaller dimensions at the top wall 36 thereof. Such taper will prevent side-to-side contact of the sliders 16, 17, 20 with each other or end pieces 12, 13 even though the sliders may be contiguously mounted therewith in resting position on the board 11. As soon as one of the sliders 16, 17, 20 is moved transversely, it will rise above the board and frictional forces between the slider being moved and adjacent sliders or slider and end piece will be reduced since no surface-to-surface contact can occur between the sides thereof.

In an actual embodiment of this invention, the game board 11, end pieces 12 and 13, sliders 16, 17 and 20 and playing pieces 14 and 15 are all molded as individual integral units of ABS plastic material although high impact styrene material or any other suitable material could also be used. The game board is about five inches wide by nine inches long and the sliders have a cross-section defining a three-quarter inch square. The playing pieces are cylindrical pegs about one inch long and one-quarter inch in diameter. The game board and sliders have a wall thickness of about 0.07 inch.

It is believed that those skilled in the art will make obvious modifications in the preferred embodiment of this invention as shown in the drawing and described herein without departing from the scope of this invention as set forth in the following claims.

What is claimed is:

1. In a board game including a plurality of playing pieces and a game board on which said playing pieces are moved, said game board having a given axis and a plurality of elongated rectilinear sliders mounted thereon for movement in side-to-side relation with respect to each other at a common angle to said given axis of said board, detent means tending to restrain each of said sliders in predetermined positions in their movement with respect to each other, and stop means for establishing the maximum extent of said movement of said sliders with respect to each other, the improvement wherein said detent means comprises a detent cam surface and a detent cam follower held in engagement solely by gravity forces acting on said sliders with said plurality of sliders each being provided with one of said detent cam surface and said detent cam follower and said game board being provided with the other of said detent cam surface and said detent cam follower and wherein said plurality of sliders are each restrained against removal from said game board by a pin engaged with a slot, said plurality of sliders each being provided with one of said pin and said slot and said board being provided with a plurality of the other of said pin and said slot.

2. The improvement as claimed in claim 1 wherein said detent cam surface is provided on said game board and said detent cam follower is provided on each of said plurality of elongated rectilinear sliders centrally of the axis of elongation thereof.

3. The improvement as claimed in claim 1 wherein each of said plurality of elongated rectilinear sliders comprises an open bottom hollow box having a pair of side walls, a pair of end walls and a top wall; said game board is provided with a plurality of elongated rectilinear rails projecting from the upper surface thereof and extending symmetrically at said common angle with respect to said given axis thereof; said rails having a length less than the length of said sliders and each being received in the open bottom of a different one of said sliders.

4. The improvement as claimed in claim 3 wherein each of said plurality of elongated rectilinear rails projecting from the upper surface of said game board is provided with a said detent cam surface extending along the free edge thereof comprising a plurality of spaced arcuate concave surfaces separated by shoulders and wherein each of said plurality of elongated rectilinear sliders is provided with a said detent cam follower centrally of the axis of elongation thereof comprising an arcuate convex surface projecting from said top wall thereof toward said open bottom thereof into engagement with said detent cam surface of said rail received therein.

5. The improvement as claimed in claim 4 wherein said top wall of each of said sliders is provided with a plurality of equally spaced playing positions in the exterior surface thereof and wherein the spacing between the centers of said equally spaced playing positions is equal to the spacing between the centers of said arcuate concave surfaces of said detent cam surface provided on said free edges of each of said plurality of elongated rectilinear rails projecting from the upper surface of said game board.

6. The improvement as claimed in claim 5 wherein said game board and said plurality of sliders are each molded as a separate integral unit and subsequently assembled with each other, each of said sliders having a given transverse dimension at said open bottom thereof tapering to slightly smaller transverse dimensions at said top wall thereof.

7. The improvement as claimed in claim 3 wherein said plurality of elongated rectilinear rails are arranged in pairs defining an undercut slot therebetween with each pair of said rails received in the open bottom of different one of said sliders and wherein each of said sliders is provided with a pin centrally of the elongated axis thereof projecting downwardly from said top wall thereof between said side walls thereof and into engagement with said undercut slot defined by the pair of said rails received in the open bottom thereof; said pin being provided with a head dimensioned to retain said pin in engagement with said undercut slot.

8. The improvement as claimed in claim 7 wherein said detent cam surface is provided on the free edges of said rails and a said detent cam follower is provided within each of said plurality of sliders centrally of the axis of elongation thereof.

9. The improvement as claimed in claim 1 wherein each of said plurality of sliders is provided with a said pin centrally of the axis thereof and said game board is provided with a plurality of slots spaced from each other and each receiving the pin of a different one of said sliders.

10. In a board game including a plurality of playing pieces and a game board on which said playing pieces are moved, said game board having a given axis and a plurality of elongated rectilinear sliders mounted thereon for movement in side-to-side relation with respect to each other at a common angle to said given axis of said board, detent means tending to restrain each of said sliders in predetermined positions in thier movement with respect to each other, and a stop means for establishing the maximum extent of said movement of said sliders with respect to each other, the improvement wherein said sliders are each mounted on said board by means comprising a pin having a head captured in a slot with said plurality of sliders each being provided with one of said pin and said slot and said game board being provided with the other of said pin and said slot; wherein said detent means comprises a detent cam surface and a detent cam follower held in engagement solely by gravity forces acting on said sliders with said plurality of sliders each being provided with one of said detent cam surface and said detent cam follower and said game board being provided with the other of said detent cam surface and said detent cam follower and wherein said head of said pin associated with each said slider is held out of engagement with said slot associated with each said slider when said detent cam surface and said detent cam follower associated with each said slider are held in engagement by said gravity forces acting on each said slider.

11. The improvement as claimed in claim 10 wherein each of said plurality of elongated rectilinear sliders is provided with a said pin projecting from a said detent cam follower centrally of the axis of elongation thereof and said game board is provided with a plurality of said slots spaced from each other and a plurality of said detent cam surfaces spaced from each other, said plurality of spaced slots and said plurality of detent cam surfaces being elongated and arranged in pairs extending at said common angle to said given axis of said game board with each said pair associated with a different one of said plurality of elongated rectilinear sliders.

12. The improvement as claimed in claim 11 wherein each of said sliders is provided with a plurality of spaced playing positions thereon with the spacing between said playing positions corresponding to the spacing between said predetermined positions in the movement of said sliders with respect to each other in which said sliders tend to be restrained by said detent means.

13. The improvement as claimed in claim 12 wherein each of said sliders is provided with a barrier wall extending between adjacent playing positions.

14. The improvement as claimed in claim 11 wherein a pair of elongated rectilinear home position members are each rigidly mounted at a different end of said game board with the axis of elongation of said members extending at said given common angle to said given axis of said board and with said plurality of sliders mounted therebetween.

15. In a board game including a plurality of playing pieces and a game board on which said playing pieces are moved, said game board having a given axis and a plurality of elongated rectilinear sliders mounted thereon for movement in side-to-side relation with respect to each other at a common angle to said given axis of said board, detent means tending to restrain each of said sliders in predetermined positions in their movement with respect to each other, and stop means for establishing the maximum extent of said movement of said sliders with respect to each other, the improvement wherein said game board is provided with a first plurality of elongated rectilinear rails projecting from one surface thereof and extending at said common angle with respect to said given axis of said game board, said plurality of rails being spaced from each other along said given axis of said game board, and wherein said sliders each comprise an open bottom hollow box having a pair of side walls, a pair of end walls and a top wall with each of said plurality of rails being loosely received within said open bottom of a different one of said sliders, each of said elongated rectilinear sliders having a length substantially greater than the length of said elongated rectilinear rails received therein.

16. The improvement as claimed in claim 15 wherein means are provided for loosely restraining each of said sliders against removal from said rail received therein.

17. The improvement as claimed in claim 16 wherein said detent means comprises a detent cam surface and a detent cam follower held in engagement solely by gravity forces acting on said sliders with said plurality of sliders each being provided with one of said detent cam surface and said detent cam follower and with said plurality of rails each being provided with the other of said detent cam surface and said detent cam follower.

18. The improvement as claimed in claim 17 wherein said game board is provided with a second plurality of elongated rectilinear rails projecting from said one surface thereof and extending at said common given angle with respect to said given axis of said game board, each of said second plurality of rails being arranged in a close spaced relation to a different one of said first plurality of rails to define a plurality of spaced pairs of rails having a slot therebetween, each of said plurality of spaced pairs of rails being received in the open bottom of a different one of said plurality of sliders and the free edge of each of said rails of said pairs of rails having a flange thereon extending into the slot therebetween, at least one rail of each of said pairs of rails having a detent cam surface extending along the free edge thereon comprising a plurality of depressions separated by shoulders; and wherein each of said plurality of sliders is provided with a pin and a detent cam follower projecting downwardly therewithin from said top wall centrally of the axis of elongation thereof with said pin being received within said slot defined by said pair of rails received within the open bottom thereof, each said pin having a head at the free end thereof dimensioned to provide an interference fit with said flanges at the free edges of said rails of said pairs of rails and a length sufficient to avoid contact between said head thereof and said flanges at the free edges of said pair of rails when said detent cam follower is in engagement with any one of said shoulders of said detent cam surface.

* * * * *